US008172701B2

(12) United States Patent
Soracco

(10) Patent No.: US 8,172,701 B2
(45) **Date of Patent: *May 8, 2012**

(54) GOLF CLUB WITH DEEP UNDERCUT

(75) Inventor: Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/181,443

(22) Filed: Jul. 12, 2011

(65) Prior Publication Data

US 2011/0269572 A1 Nov. 3, 2011

Related U.S. Application Data

(63) Continuation of application No. 12/759,149, filed on Apr. 13, 2010, now Pat. No. 7,998,001, which is a continuation of application No. 10/946,241, filed on Sep. 22, 2004, now Pat. No. 7,722,479.

(51) Int. Cl.
*A63B 53/02* (2006.01)
*A63B 53/04* (2006.01)

(52) U.S. Cl. ..... 473/350; 473/345

(58) Field of Classification Search ..... 473/290, 473/291, 305–315, 324–350, 209; D21/738–739
See application file for complete search history.

(56) References Cited

U.S. PATENT DOCUMENTS

| | | | | |
|---|---|---|---|---|
| 6,811,496 | B2 * | 11/2004 | Wahl et al. | 473/334 |
| 6,923,733 | B2 * | 8/2005 | Chen | 473/305 |
| 7,722,479 | B2 * | 5/2010 | Soracco | 473/350 |
| 7,998,001 | B2 * | 8/2011 | Soracco | 473/350 |

* cited by examiner

*Primary Examiner* — Nini Legesse
(74) *Attorney, Agent, or Firm* — Mark S. Leonardo; Brown Rudnick LLP

(57) ABSTRACT

A golf club head having a deep undercut is disclosed and claimed. The club head includes a cavity in a back portion thereof, opposite the striking face. A recess is provided in the back portion of the club head in proximity of the heel and, optionally, the sole. The recess may extend to the hosel bore, and may be separate from the cavity. An insert, such as a dampening member, a weight member, or a combination thereof, may be positioned within the recess. The recess and any insert provided therein alter the club head moment of inertia and center of gravity location, providing an improved feel to the golf club.

20 Claims, 5 Drawing Sheets

HLA, $CL_{SH}$

GOLF CLUB WITH DEEP UNDERCUT

CROSS-REFERENCE TO RELATED APPLICATIONS

This is a continuation of U.S. application Ser. No. 12/759,149, filed Apr. 13, 2010, which is a continuation of U.S. application Ser. No. 10/946,241, filed Sep. 22, 2004, now U.S. Pat. No. 7,722,479, which are incorporated herein by reference in their entireties.

BACKGROUND OF THE INVENTION

1. Field of the Invention

The present invention relates to a golf club. In particular, the present invention relates to a golf club head having a deep undercut.

2. Description of the Related Art

Golf club heads come in many different forms and makes, such as wood- or metal-type, iron-type (including wedge-type club heads), utility- or specialty-type, and putter-type. Each of these styles has a prescribed function and make-up. The present invention relates to golf club heads that have a predominantly solid material area located near the heel of the club head.

Iron-type and utility-type golf club heads generally include a front or striking face, a hosel, and a sole. The front face interfaces with and strikes the golf ball. A plurality of grooves, sometimes referred to as "score lines," is provided on the face to assist in imparting spin to the ball. The hosel is generally configured to have a particular look to the golfer, to provide a lodging for the golf shaft, and to provide structural rigidity for the club head. The sole of the golf club is particularly important to the golf shot because it contacts and interacts with the ground during the swing.

In conventional sets of iron-type golf clubs, each club includes a shaft with a club head attached to one end and a grip attached to the other end. The club head includes a face for striking a golf ball. The angle between the face and a vertical plane is called the loft angle.

The set generally includes irons that are designated number 3 through number 9, and a pitching wedge. One or more additional long irons, such as those designated number 1 or number 2, and wedges, such as a lob wedge, a gap wedge, and a sand wedge, may optionally be included with the set. Each iron has a shaft length that usually decreases through the set as the loft for each club head increases from the long irons to the short irons. The overall weight of each club head increases through the set as the shaft length decreases from the long irons to the short irons. To properly ensure that each club has a similar feel or balance during a golf swing, a measurement known as "swingweight" is often used as a criterion to define the club head weight and the shaft length. Since each of the clubs within the set is typically designed to have the same swingweight value for each different lofted club head or given shaft length, the weight of the club head is confined to a particular range.

The length of the shaft, along with the club head loft, moment of inertia, and center of gravity location, impart various performance characteristics to the ball's launch conditions upon impact and dictate the golf ball's launch angle, spin rate, flight trajectory, and the distance the ball will travel. Flight distance generally increases with a decrease in loft angle. However, difficulty of use also increases with a decrease in loft angle.

Iron-type golf clubs generally can be divided into three categories: blades and muscle backs, conventional cavity backs, and modern multi-material cavity backs. Blades are traditional clubs with a substantially uniform appearance from the sole to the top line, although there may be some tapering from sole to top line. Similarly, muscle backs are substantially uniform, but have extra material on the back thereof in the form of a rib that can be used to lower the club head center of gravity. A club head with a lower center of gravity than the ball center of gravity facilitates getting the golf ball airborne. Since blade and muscle back designs have a small sweet spot, which is a term that refers to the area of the face that results in a desirable golf shot upon striking a golf ball, these designs are relatively difficult to wield and are typically only used by skilled golfers. However, these designs allow the skilled golfer to work the ball and shape the golf shot as desired.

Cavity backs are modern designs that move some of the club mass to the perimeter of the club by providing a hollow or cavity in the back of the club, opposite the striking face. This produces a more forgiving club with a larger sweet spot. Having a larger sweet spot increases the ease of use. The decrease in club head mass resulting from the cavity also allows the size of the club face to be increased, further enlarging the sweet spot. The perimeter weighting created by the cavity also increases the club's moment of inertia, which is a measurement of the club's resistance to torque, for example the torque resulting from an off-center hit. These clubs are easier to hit than blades and muscle backs, and are therefore usable by less-skilled and beginner golfers.

Modern multi-material cavity backs are the latest attempt by golf club designers to make cavity backs more forgiving and easier to hit. Some of these designs replace certain areas of the club head, such as the striking face or sole, with a second material that can be either heavier or lighter than the first material. These designs can also contain deep undercuts, which stem from the rear cavity, or secondary cavities. By incorporating materials of varying densities or providing cavities and undercuts, mass can be freed up to increase the overall size of the club head, expand the sweet spot, enhance the moment of inertia, and/or optimize the club head center of gravity location. However, due to construction limitations or requirements, some of these designs inadvertently thicken the heel or hosel area portion of the club head. Still, these improvements make the multi-material cavity back design the easiest of all styles to hit, and are ideally suited for the less adroit or novice golfer.

SUMMARY OF THE INVENTION

The present invention relates to a golf club head. In particular, the present invention relates to an iron-type golf club head with a cavity back and a deep undercut. Traditionally, a large amount of mass or solid material in an iron-type golf club is concentrated between the bottom of the hosel bore and heel-most area of the cavity. Most of the material beyond what is required to maintain structural integrity can be considered parasitic when it comes to designing a more forgiving golf club. The present invention provides an improved golf club by removing this excess or superfluous material and redistributing it elsewhere such that it may do one or more of the following: increase the overall size of the club head, expand the size of the club head sweet spot, optimize the club head center of gravity, and/or produce a great club head moment of inertia.

A golf club head of the present invention includes a body defining a striking face, a top line, a sole, a back, a heel, a toe, and a hosel. The back contains a cavity extending in a direction toward the face, and also contains a recess in a proximity of the heel extending from the cavity below the hosel. The recess extends from the cavity to the longitudinal axis of the hosel, and may be connected to the hosel bore. Preferably, the recess is positioned in only a heel portion of the body or in only a heel and sole portion of the body.

The recess may be a hollow volume separate from the cavity. Separating the recess from the cavity precludes the possibility of any material becoming lodged therein, which may have an adverse effect.

An insert may be provided within the recess. The insert may fill the entire recess volume, or only a portion thereof. The insert may include a dampening material, such as a viscoelastic material, a foamed material, and a material having a damping coefficient greater than 0.2. The dampening member attenuates any vibrations that may be generated during the golf swing, improving the feel and playability of the club. The insert may include a weight member to increase the moment of inertia and/or reposition the center of gravity, increasing the forgiveness of the club. The insert may also be a hybrid insert, including both one or more dampening members and one or more weight members.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values, and percentages, such as those for amounts of materials, moments of inertias, center of gravity locations, and others in the following portion of the specification, may be read as if prefaced by the word "about" even though the term "about" may not expressly appear with the value, amount, or range. Accordingly, unless indicated to the contrary, the numerical parameters set forth in the following description and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in any specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
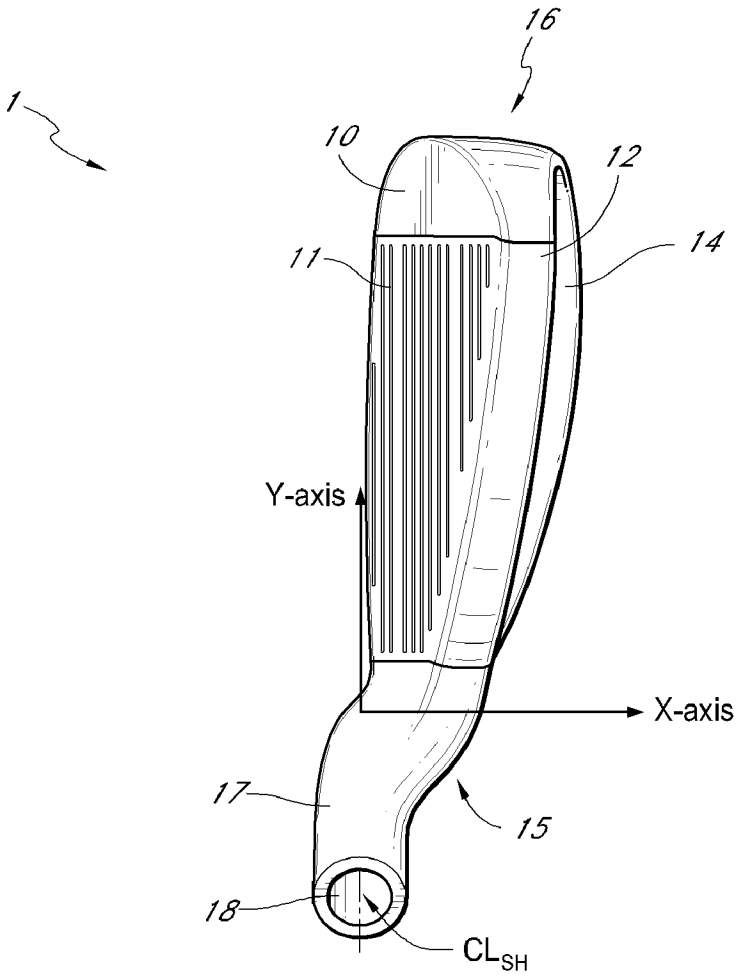
FIG. 1 is a top view of a golf club head of the present invention.
Figure 2:
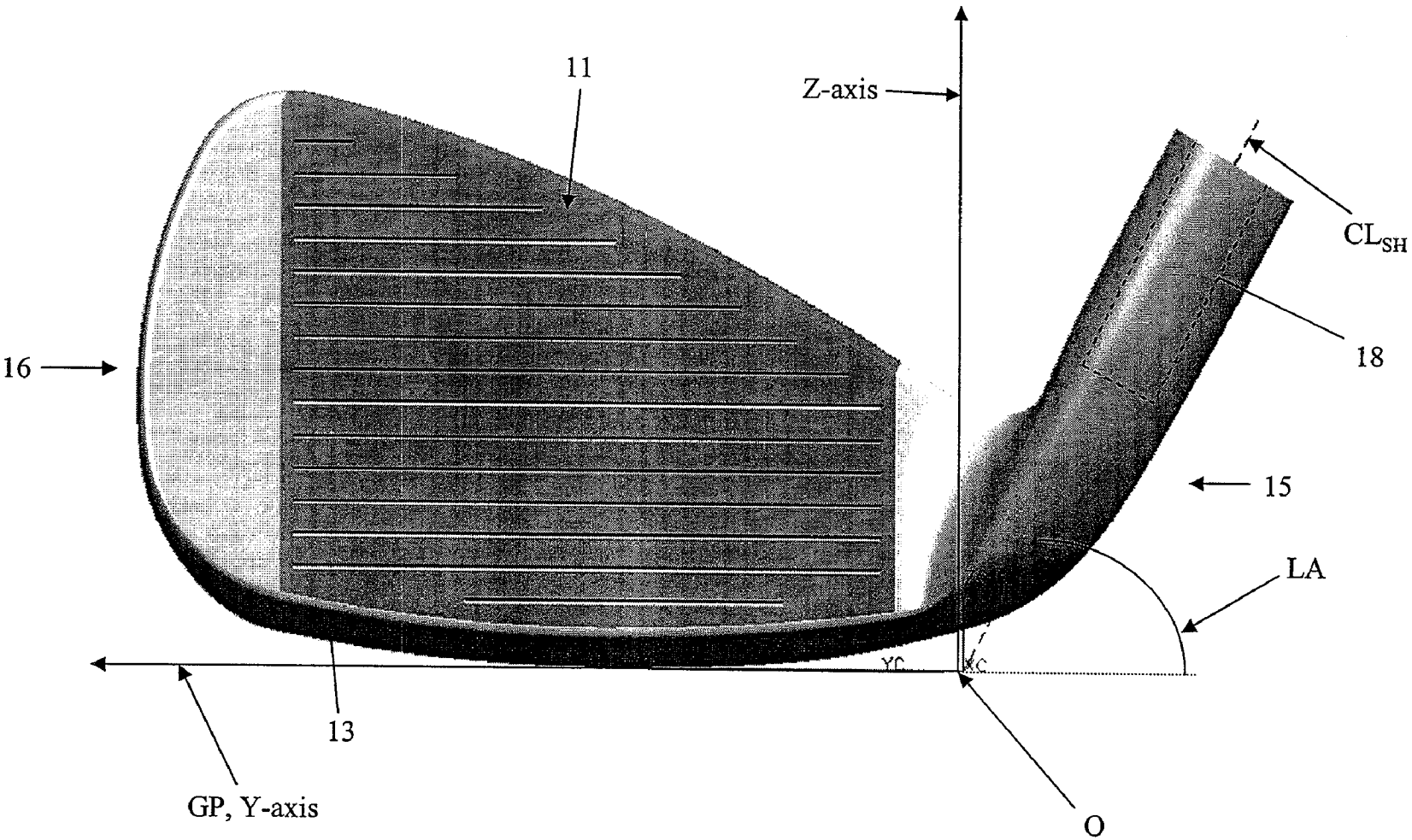
FIG. 2 is a front view of the golf club head of FIG. 1.

FIGS. 1 and 2 define a convenient coordinate system to assist in understanding the orientation of the golf club head 1 and other terms discussed herein. An origin O is located at the intersection of the shaft centerline $CL_{SH}$ and the ground plane GP, which is defined at a predetermined angle from the shaft centerline $CL_{SH}$, referred to as the lie angle LA, and tangent to the sole 13 at its lowest point. An X-axis is defined as a vector that is opposite in direction of the vector that is normal to the face 11 projected onto the ground plane GP. A Y-axis is defined as a vector perpendicular to the X-axis and directed toward the toe 16. A Z-axis is defined as the cross product of the X-axis and the Y-axis.

Figure 3:
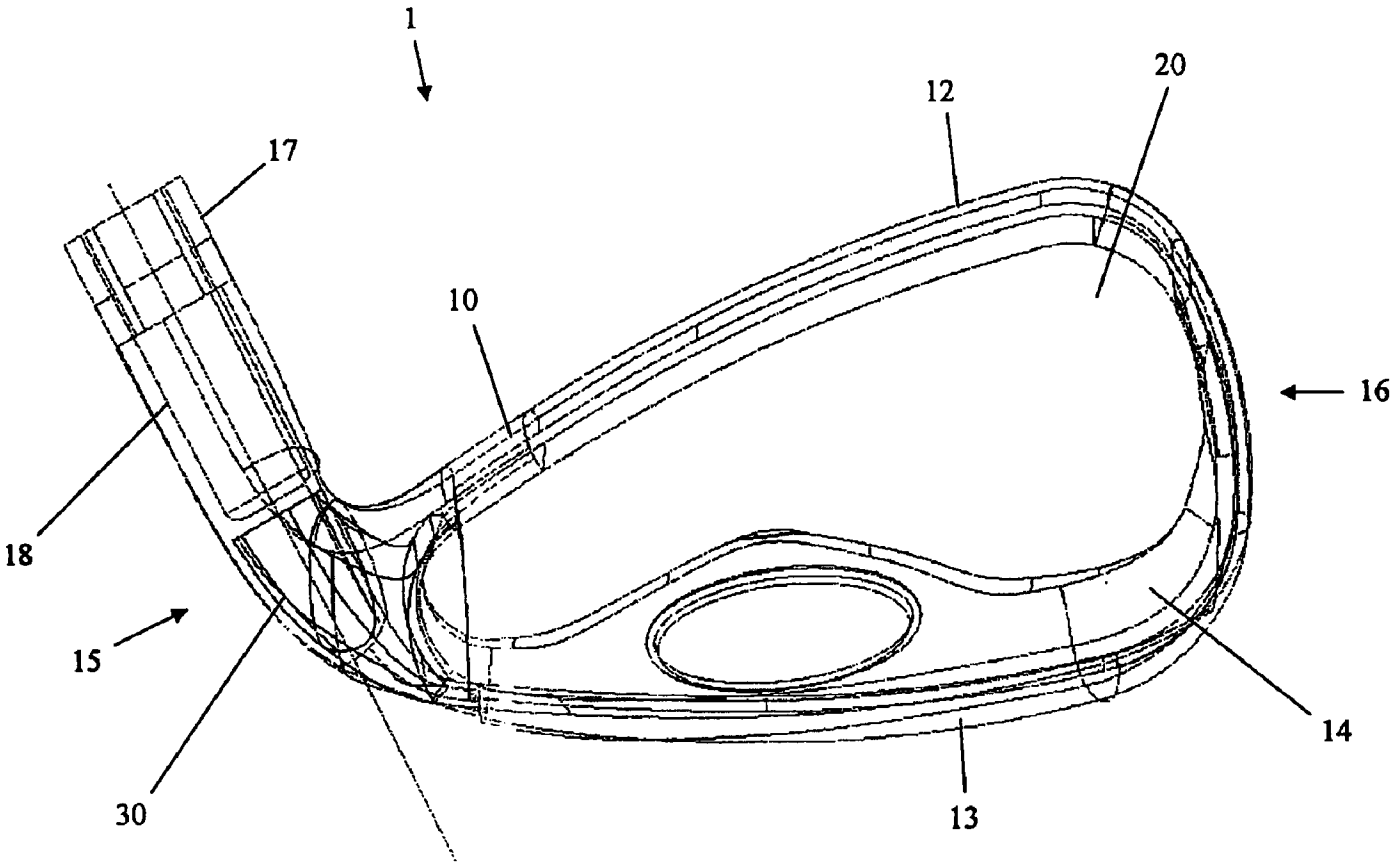
FIG. 3 shows a rear, wire frame view of a first golf club head of the present invention.

The present invention relates to a golf club having a deep undercut. FIG. 3 shows a rear, wire-frame view of a golf club head 1 of the present invention. The golf club head 1 includes a body 10 defining a striking face 11, a top line 12, a sole 13, a back 14, a heel 15, a toe 16, and a hosel 17. The hosel 17 has a bore 18 therein. The striking face 11 and the sole 13 may be unitary with the body 10, or they may be separate bodies, such as inserts, coupled thereto. The back 14 contains a cavity 20 that extends in a direction substantially toward the face 11.

The cavity 20 removes material from the club head 1, which inherently allows more of the club head mass to be distributed around the perimeter of the club head 1, giving the club designer more flexibility in maximizing the playing characteristics of the club head 1. For example, producing a greater moment of inertia (MOI) measured about either an axis parallel to the Y axis or Z axis passing through the club head center of gravity. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits. Moving or rearranging mass to the club head perimeter produces a more forgiving club.

Figure 4:
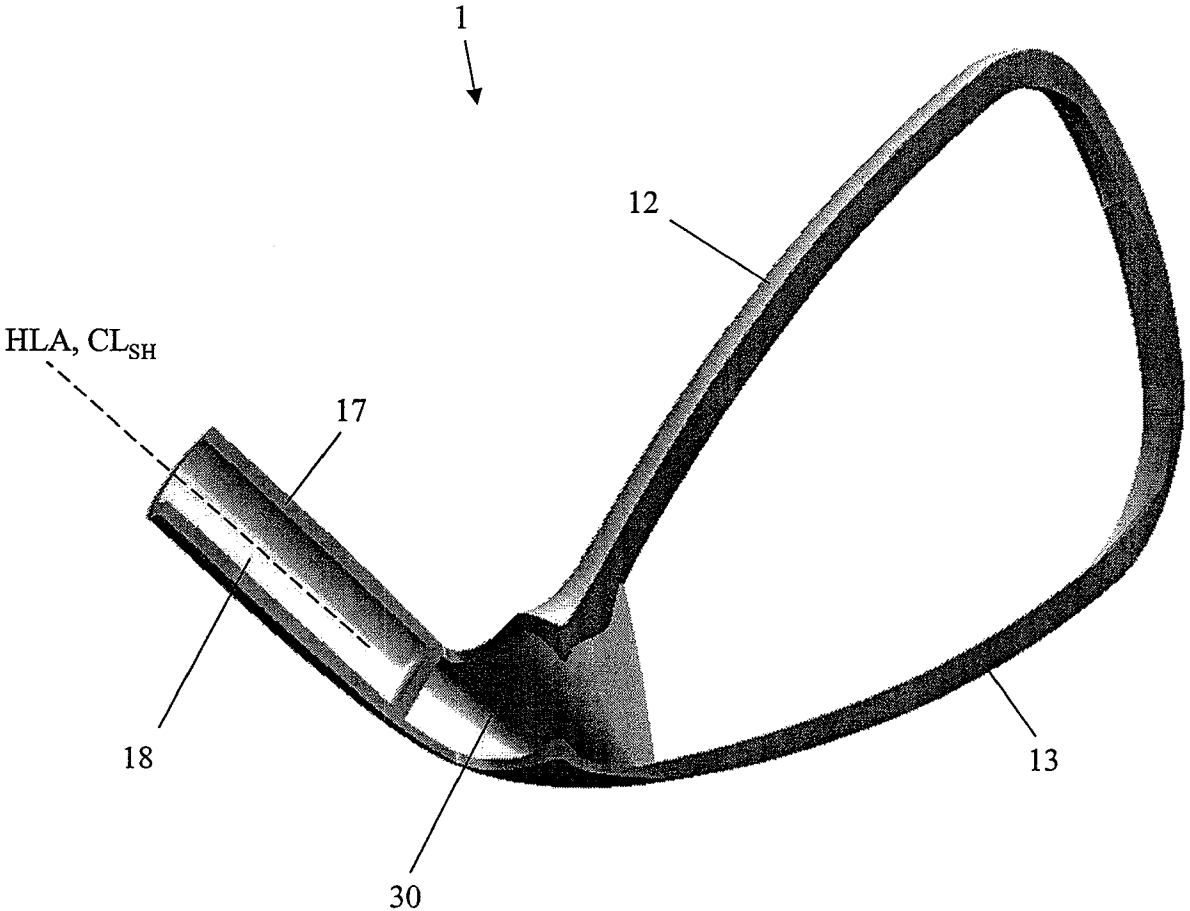
FIG. 4 shows a cut-away rear view of the golf club head of FIG. 1.

The back 14 of the golf club head 1 further includes a recess 30. The recess 30 preferably is in a proximity of the heel 15 extending from the cavity 20 toward and below the hosel 17. The hosel 17 has a longitudinal axis HLA passing through the center thereof, which is collinear with the shaft centerline $CL_{SH}$. In a preferred embodiment, the recess 30 extends to the longitudinal axis HLA. In another preferred embodiment, the recess 30 extends beyond the longitudinal axis HLA. The recess 30 may or may not be connected with the hosel bore 18. To achieve the desired balance and feel for the golf club, the recess 30 is preferably only in a heel portion of the club head 1 or in a heel and sole portion of the club head 1. Exemplary methods of creating the recess 30 include as part of a casting (if the club head 1 is a cast club head), forging, or machining. The recess 30 preferably has a depth of approximately 0.25 inch to approximately 1 inch as measured along the Y axis. The recess 30 preferably is bounded by walls having a thickness in the range of 0.02 inch to 0.4 inch. FIG. 4 shows a cut-away rear view of the golf club head 1.

Figure 5:
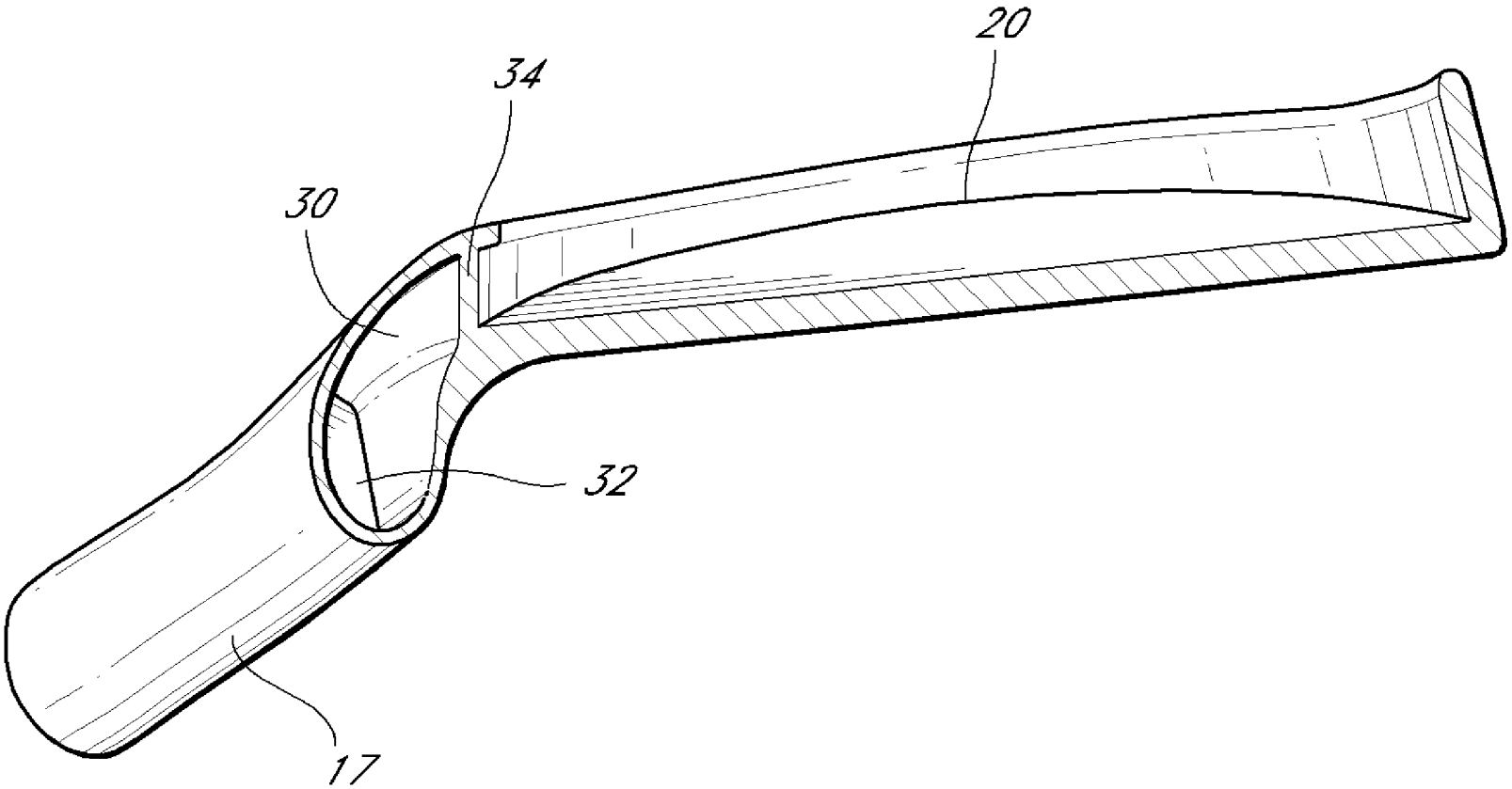
FIG. 5 shows a cut-away bottom view of another golf club head of the present invention.

The recess 30 may be a hollow volume separate from the cavity 20. Separating the recess 30 from the cavity 20 precludes the possibility of any material becoming lodged therein, which may have an adverse effect. FIG. 5 shows a cut-away bottom view of this embodiment. The recess 30 is separated from the hosel bore 18 by a first wall 32 and from the recess 20 by a second wall 34. The walls 32, 34 preferably have a thickness of approximately 0.02 inch to approximately 0.2 inch. The recess 30 may be formed by forming the club head 1 with an opening in the vicinity of the recess 30 and subsequently closing the opening by attaching a plate, such as by welding, adhesion, or binding, over the recess 30. The plate may be of the same material as the club head 1 or of a different material, and preferably has a thickness of approximately 0.02 inch to approximately 0.15 inch. The plate may be decorative.

The recess 30, in any embodiment of the present invention, preferably displaces approximately 3 to approximately 25 grams of mass from the body 10. Furthermore, the recess 30 may be left hollow or it may have an insert positioned therein. The insert may fill substantially all of the recess 30 or only a portion thereof, and is retained within the recess 30 in known fashion, such as by an adhesive. The insert may include a dampening material to attenuate any vibrations that may be generated during the golf swing, improving the feel and playability of the club. Preferred dampening materials include a viscoelastic material, a foamed material, a material having a damping coefficient greater than 0.2, and combinations thereof. A damping coefficient is a material property that indicates whether a material will dissipate or return energy to a system. A high damping coefficient indicates that the material will absorb a fair amount of vibrational energy; while a low damping coefficient indicates that the material will not absorb much vibrational energy. The dissipated vibrational energy is converted into sound and/or heat.

The insert may include a weight member to further bias the location of the club head center of gravity and the playing characteristics of the club. The weight member preferably has a mass of approximately 5 grams to approximately 50 grams. Characterized differently, the weight member preferably has a weight of approximately 2% to approximately 30% of the club head weight (as measured without the weight member). The weight member has a center of gravity that preferably is located a distance of approximately 1 inch to approximately 2.5 inches from the club head center of gravity. More preferably, this distance is from approximately 1.2 inches to approximately 2.5 inches, and still more preferably it is from approximately 1.5 inches to approximately 2.5 inches.

The weight member will shift the location of the club head center of gravity. Its positioning within the recess 30 and the location of the recess 30 can produce significant center of gravity shifts. The club designer can choose the insert in order to shift the club head center of gravity as needed based on a user's swing characteristics. For example, the designer can choose the insert to help alleviate a golfer's tendency to hook or slice the ball. The distance from the center of gravity location of the club head without the weight member to the center of gravity location of the club head including the weight member preferably is from approximately 0.01 inch to approximately 0.1 inch.

The insert may be a hybrid insert. Exemplary hybrid inserts include a dampening member with one or more isolated weight members positioned therein and a layered insert including one or more layers of a dampening material and one or more layers of a weight member.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. An iron-type golf club head comprising:

a body defining a striking face, a topline, a sole, a back, a heel, a toe, and a hosel, wherein the back comprises:

a cavity extending in a direction toward the face;

a recess defining an enclosed hollow volume bounded by walls extending toward the sole and separated from the cavity by a first wall disposed between the recess and the cavity such that said first wall precludes the possibility of any material from said cavity becoming lodged in said recess; and an insert disposed within the recess, wherein the insert comprises at least one damping member.

2. The golf club head of claim 1, wherein the insert fills the volume of the recess.

3. The golf club head of claim 1, wherein the damping member comprises a material having a damping coefficient greater than 0.2.

4. The golf club head of claim 1, wherein the hosel comprises a bore extending into the body below a portion of the topline, wherein the recess is separated from the bore by a second wall disposed between the recess and the bore.

5. The golf club head of claim 4, wherein the first and second walls each have a thickness of approximately 0.2 inch to 0.4 inch.

6. The golf club head of claim 1, wherein the hosel comprises a bore extending into the body below a portion of the top line, and wherein the recess is connected to the bore.

7. The golf club head of claim 1, wherein the recess is only in a heel portion of the body.

8. The golf club head of claim 1, wherein the recess is located in a heel and sole portion of the body.

9. The golf club head of claim 1, wherein the damping member comprises a viscoelastic material.

10. The golf club head of claim 1, wherein the hosel has a longitudinal axis, and wherein the recess extends from the cavity to the longitudinal axis of the hosel.

11. An iron-type golf club head comprising:

a body defining a striking face, a topline, a sole, a back, a heel, a toe, and a hosel, wherein the back comprises:

a cavity extending in a direction toward the face;

a recess defining an enclosed hollow volume bounded by walls extending toward the sole and separated from the cavity by a first wall disposed between the recess and the cavity such that said first wall precludes the possibility of any material from said cavity becoming lodged in said recess; and an insert disposed within the recess, wherein the insert comprises at least one weight member.

12. The golf club head of claim 11, wherein the insert fills the volume of the recess.

13. The golf club head of claim 11, wherein the hosel comprises a bore extending into the body below a portion of the topline, wherein the recess is separated from the bore by a second wall disposed between the recess and the bore.

14. The golf club head of claim 13, wherein the first and second walls each have a thickness of approximately 0.2 inch to 0.4 inch.

15. The golf club head of claim 11, wherein the hosel comprises a bore extending into the body below a portion of the top line, and wherein the recess is connected to the bore.

16. The golf club head of claim 11, wherein the recess is only in a heel portion of the body.

17. The golf club head of claim 11, wherein the recess is located in a heel and sole portion of the body.

18. The golf club head of claim 11, wherein the weight member comprises approximately 2 percent to approximately 30 percent of the club head weight.

19. The golf club head of claim 11, wherein the weight member has a center of gravity located a distance of approximately 1 inch to approximately 2.5 inches from a center of gravity of the club head.

20. The golf club head of claim 11, wherein the hosel has a longitudinal axis, and wherein the recess extends from the cavity to the longitudinal axis of the hosel.

* * * * *